US008050149B2

(12) United States Patent
Karapatis et al.

(10) Patent No.: US 8,050,149 B2
(45) Date of Patent: Nov. 1, 2011

(54) GONG FOR THE STRIKING WORK OR ALARM OF A WATCH

(75) Inventors: Nakis Karapatis, Premier (CH); Jérôme Favre, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 311 days.

(21) Appl. No.: 12/418,817

(22) Filed: Apr. 6, 2009

(65) Prior Publication Data

US 2009/0278670 A1 Nov. 12, 2009

(30) Foreign Application Priority Data

Apr. 4, 2008 (CH) ..... 0520/08

(51) Int. Cl.
*G04B 23/02* (2006.01)
*G04B 21/00* (2006.01)

(52) U.S. Cl. ..... 368/244; 368/273

(58) Field of Classification Search ..... 368/243–244, 368/267, 269, 272–273
See application file for complete search history.

(56) References Cited

U.S. PATENT DOCUMENTS

| | | | | |
|---|---|---|---|---|
| 202,020 | A * | 4/1878 | Gray | 84/199 |
| 303,651 | A * | 8/1884 | Ludwig | 84/199 |
| 644,757 | A | 3/1900 | Barton | |
| 4,619,846 | A | 10/1986 | Oborzil et al. | |
| 5,578,775 | A | 11/1996 | Ito | |
| 5,881,026 | A | 3/1999 | Baur et al. | |
| 7,017,645 | B2 | 3/2006 | Johnson et al. | |
| 7,021,819 | B2 | 4/2006 | Schmiedchen | |
| 7,412,848 | B2 | 8/2008 | Johnson et al. | |
| 2008/0041213 | A1 | 2/2008 | Richter | |
| 2008/0074956 | A1 | 3/2008 | Karapatis | |
| 2008/0185076 | A1 | 8/2008 | Schroers et al. | |
| 2009/0091431 | A1 | 4/2009 | Chritin et al. | |
| 2009/0107319 | A1 | 4/2009 | Stannard | |
| 2009/0272246 | A1 * | 11/2009 | Richter | 84/297 S |

FOREIGN PATENT DOCUMENTS

| | | |
|---|---|---|
| JP | 55-125800 | 9/1980 |
| JP | 61-252797 | 11/1986 |
| WO | 00/36473 | 6/2000 |
| WO | 03/064076 A1 | 8/2003 |
| WO | 2004/047582 A2 | 6/2004 |
| WO | 2006/045106 A1 | 4/2006 |
| WO | 2006/095244 A2 | 9/2006 |

OTHER PUBLICATIONS

Bulk Metallic Glass Composites—sciencemag.org; Sep. 10, 2010.*
Metallic Glass parts—gizmag.com; May 17, 2011.*

(Continued)

*Primary Examiner* — Sean Kayes
(74) *Attorney, Agent, or Firm* — Griffin & Szipl, P.C.

(57) ABSTRACT

The gong for the striking work or alarm of a watch is configured to produce a sound within the audible frequency range when it is struck by at least one hammer. This gong is made of a material, wherein the square root of the ratio of the elasticity module of the material divided by the volumic mass of the selected material is less than 3300 m/s, so as to allow the gong to produce a rich sound, comprising a large number of partials, within the audible frequency range. The selected material may be, for example, a material having an amorphous structure, such as a metallic glass.

6 Claims, 3 Drawing Sheets

OTHER PUBLICATIONS

Definition Gong—nawcc-index.net/Articles/Antiquorum-Lexico.pdf; Jun. 17, 2011.*
Final Office Action issued in co-pending related U.S. Appl. No. 12/417,236 on May 5, 2011.
European Search Report issued in a related European application 09 15 4671, completed Sep. 27, 2010 and mailed Oct. 1, 2010.
Office Action issued in co-pending related U.S. Appl. No. 12/417,236, dated Mar. 4, 2010.
Green Hobby Model (GHM)—greenhobbymodel.com/woodsheet.html; Mar. 17, 2006.
Wikipedia, Piano Wire—en.wikepedia.org/wiki/Piano_wire; Jul. 13, 2006.
Internet Archive—web.archive.org/web/*/...Piano_wire; Nov. 5, 2010.
Internet Archive—web.archive.org/web/...WoodSheet.html; Nov. 5, 2010.
Office Action issued in co-pending related U.S. Appl. No. 12/417,236, mailed Nov. 18, 2010.
Search Report issued in corresponding Swiss patent application No. 0520/08, completed Dec. 9, 2008.

* cited by examiner

GONG FOR THE STRIKING WORK OR ALARM OF A WATCH

This application claims priority from Swiss Patent Application No. 00520/08 filed Apr. 4, 2008, the entire disclosure of which is incorporated herein by reference.

FIELD OF THE INVENTION

The invention concerns a gong of specific geometry for the striking work or alarm of a watch.

BACKGROUND OF THE INVENTION

In the field of horology, a conventional architecture is used for making movements, which are fitted with striking mechanisms, such as minute repeaters. In such embodiments, the gong used is a metal wire, which may have a circular shape. This metal wire is arranged around the movement, in the watch frame. The gong is secured, for example by hard soldering, to a gong-carrier, which is itself secured to the watch plate. The gong vibration is produced by the impact of at least one hammer, generally in proximity to the gong-carrier. This vibration is made up of several natural frequencies (or partials), the number and intensity of which, in particular within the audible range, depend upon the geometry of the gong and the physical properties of the gong material.

Generally, to produce a musical sound whose pitch is fixed in the entire sound spectrum, there is a fundamental frequency, which is also called the first harmonic, and one or several harmonics, which are whole number multiples of the fundamental frequency. In other cases, where frequencies higher than the fundamental frequency are no longer whole number multiples of the lowest frequency, such frequencies are termed partials. A sound with several partials is usually encountered in percussion instruments or some string instruments, or during strike transients, such as the shock or impact of a hammer against the gong of a watch striking work, as for the present invention.

A certain proportion of partials is audible within the 1 kHz to 20 kHz frequency range, when the hammer strikes the gong (the lower limit being given by the radiation capacities of the watch, whereas the upper limit is the auditory capacity of the human ear). Within this frequency range, the larger the number of partials, the richer the generated sound will be considered. Using one type of gong material, it is only possible to increase this richness of sound by altering the geometry of the gong, i.e. for example by making a cathedral type gong. This type of gong includes two windings instead of a single winding around the watch movement, which may cause a problem of space within the watch case.

As indicated above, a gong for the striking work of a watch can include a metal wire of circular shape surrounding one part of the watch movement, as shown, in part, in WO Patent No. 2006/095244. This metal wire may be made, for example, of steel, to produce a vibration, which thus includes several partials within the audible frequency range. However, it has been observed that with a steel gong of a given geometry, the number of partials within the audible frequency range is insufficient for the vibrating gong to produce a rich sound, in particular in the low frequencies.

SUMMARY OF THE INVENTION

It is thus an object of the invention to overcome the drawbacks of the state of the art by providing a gong for the striking work or alarm of a watch that can produce a rich sound having a large number of partials within the audible frequency range.

The invention therefore concerns according to the present invention a first embodiment of a gong of specific geometry for the striking work or alarm of a watch, wherein the gong is made of a material having an amorphous structure, wherein the square root of the ratio of the elasticity module of the material divided by the volumic mass of the selected material, is less than 3300 m/s, in order to allow the vibrating gong to produce a rich sound comprising several audible partials within an audible frequency range from 1 kHz to 20 kHz. Additional, particular beneficial, embodiments of the invention are provided in accordance with the following subsidiary gongs of specific geometry.

In accordance with a second embodiment of the invention, the first embodiment is modified so that the material used is a precious metal or an alloy of precious metals. In accordance with a third embodiment of the invention, the second embodiment is modified so that the precious metal is chosen from among yellow gold, grey gold, red gold, platinum, palladium or silver. In accordance with a fourth embodiment of the invention, the first embodiment is further modified so that the material used is a metallic glass. In accordance with a fifth embodiment of the invention, the fourth embodiment is further modified so that the metallic glass is zirconium, gold or platinum based. In accordance with a sixth embodiment of the invention, the first embodiment is further modified so that said gong is a precious metal wire, one part of which defines a portion of a circle at an angle comprised between 180° and 360° for arrangement around a watch movement inside the watch case, and it is devised such that the sound produced by the vibrating gong includes a number of audible partials that is higher than or equal to 8.

One advantage of the gong according to the present invention, which is made of a material with a specific relation between elasticity module and volumic mass, is that the sound produced is richer for a given size of said gong compared to previously used materials, such as steel. It is possible to produce a cathedral type sound, by using a single metal wire winding in the watch case, and not two windings, as in the state of the art. The acoustic intensity is improved because of the increase in the transmission coefficient to the watch parts located downstream of the gong. By selecting a type of material, such as a precious metal, the quality of the sound produced by the gong is improved, because of the larger number of partials that can propagate towards the radiating parts of the watch.

BRIEF DESCRIPTION OF THE DRAWINGS

The objects, advantages and features of the gong for the striking work or alarm of a watch will appear more clearly in the following description, particularly with reference to the drawings, in which.

DETAILED DESCRIPTION OF THE INVENTION

Figure 1:
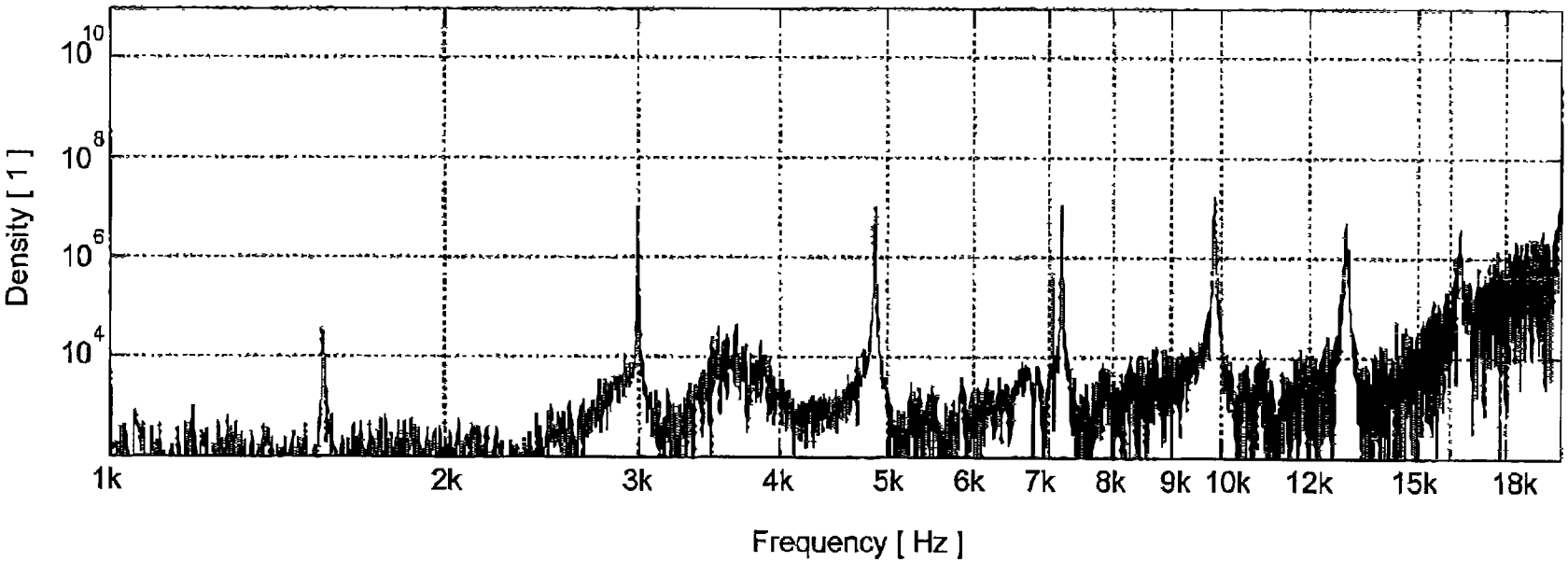
FIG. 1 shows a graph of the spectral density of the sound emitted by a steel gong vibrating within the audible frequency range.

The gong of the present invention is made of a type of material that increases the richness of the sound produced by the vibration of said gong with a high number of audible partials. This high number of partials is determined within the audible frequency range, i.e. from 1 kHz to 20 kHz. The material may mainly have an amorphous structure, such as a metallic glass.

In addition to the well-defined geometric shape, the selected material must thus enable the mode density $\eta$ in the audible frequency range to be controlled and optimised. This mode density is influenced by various parameters, including, mainly, the properties of the selected material. Mode density $\eta$ is inversely proportional to the square root of the elasticity module E of the material, divided by the volumic mass $\rho$ of said material in accordance with the following formula:

$$1/\eta\alpha(E/\rho)^{1/2}[m/s]$$

However, the speed of the sound produced by the gong is directly proportional to the square root of elasticity module E divided by the volumic mass $\rho$, which is defined in m/s.

The type of material used for making a watch gong can advantageously be selected from among precious metals, such as yellow gold, grey gold, red gold, platinum, palladium and silver, for example. For yellow gold, the value of the square root of elasticity module E divided by the volumic mass $\rho$ is 2222 m/s; for a gong of standard geometry, with up to 11 audible partials. For grey gold, this value is 2606 m/s with around 10 audible partials. For red gold, this value is 2556 m/s with around 10 audible partials. For platinum, this value is 2822 m/s with 9 to 10 audible partials. For palladium, this value is 3172 m/s with around 9 audible partials. For silver, this value is 2813 m/s with 9 to 10 audible partials.

As can be seen from the values stated above, the value, for all of these precious metals, of the square root of elasticity module E divided by volumic mass $\rho$ is less than 3300 m/s. By way of comparison, if the gong is made, in a conventional manner, of 20AP steel or piano wire, this value is higher than 5000 m/s with 7 partials in the audible frequency range. If diamond is used as gong material, this value is higher than 16850 m/s with only 4 audible partials. This clearly demonstrates that making a gong of standard geometry with a precious metal guarantees that the vibrating gong will produce a rich sound with a high number of audible partials and without producing a cacophonous sound.

It should also be noted that, advantageously, with a gong made of a precious metal, such as gold, the number of partials is even higher relative to the number of partials of a steel gong, in particular within the range of 1 kHz to 10 kHz, which is the zone of maximum sensitivity for the human ear.

In addition to using these precious metals, one could also envisage using a material with an amorphous, rather than a crystalline structure, which could be a metallic glass. The metallic glass may be manufactured from a molten state by rapid quench. The metallic glass may be, for example, zirconium, gold or platinum based, or based on any other metal that can solidify in amorphous form. For technical details relating to the method of making an article using an amorphous metal or alloy, the reader may refer to WO Patent No. 2003/064076, which is equivalent to U.S. Pat. No. 7,017,645, the entire disclosure of which is incorporated herein by reference. Moreover, the reader may also refer to WO Patent No. 2004/047582, which describes a precious metal alloy for making a piece of jewelry, and to WO Patent No. 2006/045106, which describes an amorphous alloy, including, for example, gold with palladium, platinum and silver, the entire disclosure of U.S. Pat. No. 7,412,848, equivalent to WO Patent No. 2004/047582, and the entire disclosure of U.S. Patent Application Publication No. 2008/0185076 A1, equivalent to WO Patent No. 2006/045106 are incorporated herein by reference.

Figure 3:
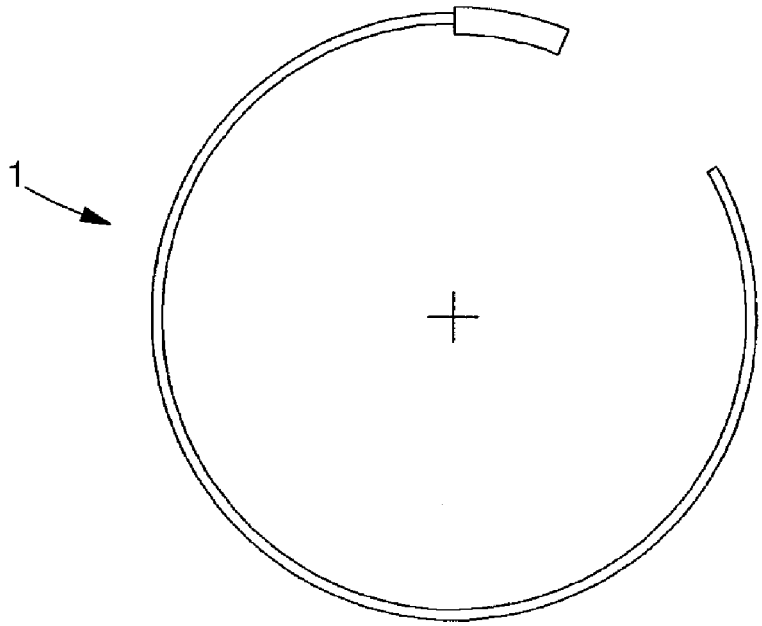
FIG. 3 shows a top view of an embodiment of the gong according to the invention.

The gong 1 of specific geometry for the striking work or alarm of a watch, as illustrated in FIG. 3, may be a metal or metallic glass wire of rectangular or circular section, with a diameter of less than 1 mm, for example of the order of 0.6 mm. This metallic wire is secured to a gong-carrier connected to the watch plate, and may partially surround the watch movement, which may have a diameter of the order of 12'''½. The metal or metallic glass wire of the gong thus describes a single winding in the form of a toroid portion with an angle comprised, for example, between 180° or less, and 360°, and preferably of the order of 330°.

The gong with the above shape may thus advantageously be made of a material, wherein the square root of elasticity module E divided by the volumic mass $\rho$, is less than 3300 m/s. This material may preferably be yellow gold, grey gold, or red gold, which is easy to work to obtain said gong, and has a high number of partials mainly in the 1 kHz to 10 kHz range. With the gong thus formed of a single winding of precious metal wire, it is possible to produce a "cathedral" type sound, which makes the gong more compact for mounting in a watchcase. With a steel gong, there must be two metal wire windings to achieve the same type of sound.

Figure 2:
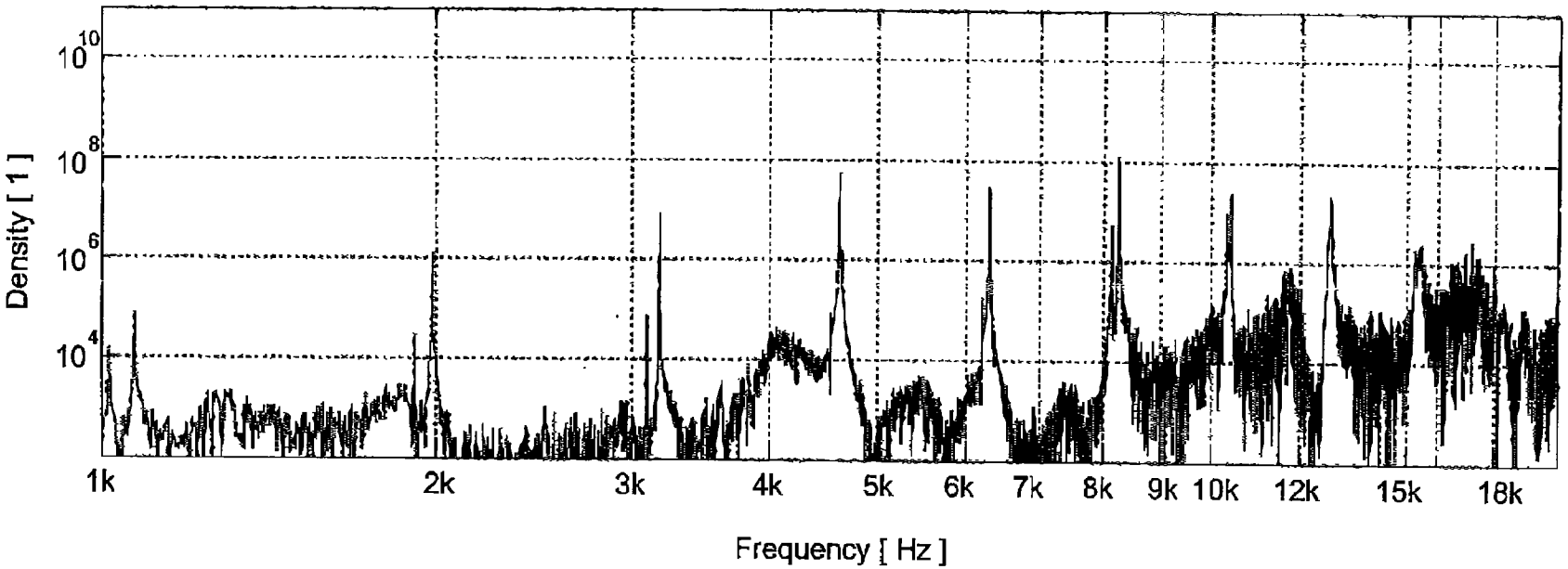
FIG. 2 shows a graph of the spectral density of the sound emitted by a gold gong according to the invention vibrating within the audible frequency range.

In order to demonstrate properly the advantage of using a material such as gold instead of the conventional steel for making a gong of the shape indicated above, FIGS. 1 and 2 show two graphs of the spectral density of the sound emitted by a gong vibrating in the 1 kHz to 20 kHz frequency range. FIG. 1 shows a gong made of steel, while FIG. 2 shows a gong made of gold. These Figures show peaks corresponding to the audible partials in the sound produced by the vibrating gong. The larger the number of peaks or partials, the richer the sound will be for auditory perception by the human ear.

In FIG. 1 there are 7 audible partials for the steel gong, which gives a mode density $\eta$=0.37 kHz$^{-1}$. However, in FIG. 2 at least 9 audible partials can normally be observed for the gold gong, which gives a mode density $\eta$=0.47 kHz$^{-1}$. A gain of the order of 30% can be observed with a gold gong compared to a conventional steel gong, in addition to a shift towards lower frequencies (for a given geometry).

It should be noted that, in addition to the selected material, such as a precious metal, account must be taken of the geometry of said gong so as to avoid having two peaks that are too close to each other in the audible frequency range, since, in such case, a dissonant sound may be perceived. The gong geometry must thus be optimised, in order to prevent such double peaks in the audible frequency range. For example, filing can be carried out close to the place where the gong is secured.

From the description that has just been given, those skilled in the art can use several materials, other than precious metals, which satisfy the conditions stated above, to make a gong of specific geometry for the striking work of a watch, without departing from the scope of the invention as defined by the claims. These selected materials must allow at least 8 partials to be perceived within the audible frequency range. The selected material may be a non-precious alloy that satisfies the above conditions. It should be noted that other properties, in particular the intrinsic quality factor, govern the choice of a material for making a gong.

What is claimed is:

1. A gong of specific geometry for the striking work or alarm of a watch, wherein the gong is made of a material having an amorphous metal or amorphous metallic alloy structure, wherein the square root of the ratio of the elasticity module of the material divided by the volumic mass of the selected material, is less than 3300 m/s, in order to allow the vibrating gong to produce a rich sound comprising several audible partials within an audible frequency range from 1 kHz to 20 kHz.

2. The gong according to claim 1, wherein the material used is a precious metal or an alloy of precious metals.

3. The gong according to claim 2, wherein the precious metal is chosen from among yellow gold, grey gold, red gold, platinum, palladium or silver.

4. The gong according to claim 1, wherein the material used is a metallic glass.

5. The gong according to claim 4, wherein the metallic glass is zirconium, gold or platinum based.

6. The gong according to claim 1, said gong being a precious metal wire, one part of which defines a portion of a circle at an angle comprised between 180° and 360° for arrangement around a watch movement inside the watch case, wherein it is devised such that the sound produced by the vibrating gong includes a number of audible partials that is higher than or equal to 8.

* * * * *